US007044730B1

(12) United States Patent
Mougey

(10) Patent No.: US 7,044,730 B1
(45) **Date of Patent: *May 16, 2006**

(54) DEVICE FOR IMPROVING GAS FUEL BURNING

(75) Inventor: Gérard Mougey, Honfleur (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/869,523

(22) PCT Filed: Dec. 28, 1999

(86) PCT No.: PCT/FR99/03299

§ 371 (c)(1),
(2), (4) Date: Oct. 18, 2001

(87) PCT Pub. No.: WO00/40901

PCT Pub. Date: Jul. 13, 2000

(30) Foreign Application Priority Data

Dec. 30, 1998 (FR) ..... 98 16621

(51) Int. Cl.
*F23D 14/62* (2006.01)
*F23D 14/64* (2006.01)

(52) U.S. Cl. ..... 431/354; 431/202

(58) Field of Classification Search ..... 431/5, 431/202, 354, 355; 239/419.5, 589, 592, 239/553.5, 553, 566; 48/3 R, 180.1, 189.3; 417/151, 179, 180, 155–157; 110/127, 150, 110/157; 261/119.2, 116
See application file for complete search history.

(56) References Cited

U.S. PATENT DOCUMENTS

| | | | | |
|---|---|---|---|---|
| 315,187 | A * | 4/1885 | Thomas | 417/179 |
| 1,181,125 | A * | 5/1916 | Erlwine | 417/179 |
| 1,264,116 | A * | 4/1918 | Moss | 417/179 |
| 1,421,840 | A * | 7/1922 | Schmidt | 417/184 |
| 1,449,504 | A * | 3/1923 | Ehrhart | 417/54 |
| 2,072,599 | A * | 3/1937 | Lemaitre | |
| 2,074,480 | A * | 3/1937 | Maclean | 417/198 |
| 2,111,266 | A * | 3/1938 | Hopkins | 417/179 |
| 2,164,263 | A * | 6/1939 | Wall | 417/179 |
| 2,403,431 | A | 7/1946 | Dobrin | |
| 3,101,773 | A * | 8/1963 | Blaha | |
| 3,659,962 | A * | 5/1972 | Zink et al. | 417/179 |
| 4,026,817 | A * | 5/1977 | Ciuti et al. | 516/53 |
| 4,445,464 | A * | 5/1984 | Gerstmann et al. | 122/18.4 |
| 4,586,873 | A * | 5/1986 | Lepretre et al. | 417/54 |
| 4,784,810 | A * | 11/1988 | Jorzyk et al. | 261/17 |
| 6,638,059 | B1 * | 10/2003 | Mougey | 431/202 |

FOREIGN PATENT DOCUMENTS

| | | | |
|---|---|---|---|
| EP | 99828 | * | 2/1984 |
| FR | 000521176 | * | 7/1921 |
| SU | 1236253 | * | 6/1986 |
| WO | WO 89/07898 | * | 9/1989 |

* cited by examiner

*Primary Examiner*—Carl D. Price
(74) *Attorney, Agent, or Firm*—Sughrue Mion, PLLC

(57) ABSTRACT

The invention concerns a device for bringing together a gas fuel and an oxidant in proportions providing optimal burning, so as to obtain, in particular for a fuel gas supplied with low pressure level and containing hydrocarbons, a smokeless burning.

Said device comprises a central supply 1, consisting of at least one tube located in the axis of a body forming a venturi 2, and through which the fuel gas is input. The invention is characterized in that a plurality of tubes 6 is provided in annular arrangement around the central supply 1.

5 Claims, 2 Drawing Sheets

DEVICE FOR IMPROVING GAS FUEL BURNING

The invention concerns a device for bringing together a gas fuel and an oxidant in proportions providing optimal burning, so as to obtain, in particular for a fuel gas supplied with low pressure level and containing hydrocarbons, a smokeless burning.

BACKGROUND OF THE INVENTION

It is known that the ratio between the flow of gas to be burned and the air flow required for combustion should at all times be equal to or greater than the stoichiometric ratio in order for a burner to be able to operate entirely independently with no additional supply of external air. It is also known that the combustion of gas containing hydrocarbons, to burn off waste gases containing hydrogen sulfide, for example, or gas emissions containing hydrocarbons at an oil refinery or oil or gas production field, must meet three essential conditions, generally called "the three T's" in the industry, to obtain optimal combustion.

Indeed, if the quantity of air required for combustion is insufficient and if these three T's, that is, the Temperature of the flame, the Time the air and gas are mixed before burning, and the Turbulence applied to this mixture, are not observed, foul smelling odors and thick black smoke, essentially composed of unburned hydrocarbons, are emitted by the incomplete combustion of these gases or gaseous emissions, thus harming the environment.

One of the major causes of this incomplete combustion, and particularly of the appearance of black smoke at the point of combustion, is therefore primarily the result of an insufficient amount of air, detrimental to good combustion free of unburned hydrocarbons. Indeed, when the flow of gas to be burned is large, for example, and the supply pressure of this fuel gas is very low, commercially available burners are generally ineffective in permitting aeration of the flame sufficiently activated by the pressure of the gas coming out of the supply tube of the burner. An external supply of air needed for combustion must therefore be provided, by any means available in the technology, for example by supplying a fuel-oxidant mixture energy by means of water vapor.

Devices have been proposed to obtain sufficient mixing energy from large quantities of air, using external fluids such as water vapor going through injectors, or other fluids acting as "motive fluids," for example when the air itself is compressed, or using powerful blowers to induce the air and turbulence required for combustion. These devices generally have low yields, so in order to compensate for their lack of efficiency it is necessary to use large quantities of motive fluids which are not always available in the amounts required on the waste gas combustion site.

As a result, when water vapor is used as a motive fluid, for example, the high rate of consumption produces the following disadvantages:

- high noise emission due to the passage of the fluid in the tubes and injectors,
- a cooling of the flame so that the correct conditions for combustion of the gases are not ensured; for example, acidic gases such as $H_2S$, for which the temperature of 700° C. required for complete oxidation is not reached under these conditions, resulting in toxic and foul smelling emissions.
- an energy balance on the site could be deficient because of the dependence on production of water vapor.

In oil and gas production fields, water vapor is generally not available and because the pressure of gas to be burned is too low to act as motive gas, that is, that the gas itself could entrain enough air needed for its combustion and thus obtain sufficient fuel-oxidant mixing energy, the combustion of these gases containing hydrocarbons is therefore incomplete, resulting in thick black smoke from the burning site.

Manufacturers of burners have proposed a system of aeration of the flame of a burner that consists of supplying air for the combustion by means of high power blower units arranged beneath the burner, and by using automatic valves to control the distribution of gas in accordance with the capacity to be burned. There is an unacceptable risk of failure in this system, controlled by complex instrumentation, because a dangerous obstruction could be created in the manifold of gases to be burned at a refinery, when for example an automatically controlled valve remains in the closed position. Furthermore, this system for aeration of the flame proves to have a high capital cost and operating expenses even while it is not very reliable and generates safety problems when the gas to be burned contains liquid hydrocarbons, also called condensates, easily flammable, which can fall on the blowers arranged beneath the burner.

FR-A-2 095 661 deals with an air aspirator using as a motive fluid a gas under pressure, the nature of which is not specified. This air aspirator has a plurality of gas injection tubes arranged in two concentric rings at the input of a venturi tube open to the atmosphere and the axes of which are parallel to the axis of the venturi tube.

U.S. Pat. No. 2,403,431 describes a fuel gas burner having a plurality of injection tubes arranged at the input of a venturi tube open to the atmosphere. These tubes, parallel to the axis of the venturi tube, are supplied with a premixture of fuel gas and air, this premixture coming from another venturi tube placed upstream and open to the atmosphere or connected to a source of air under pressure.

European patent No. 99 828, held by the Applicant, proposes a device for the combustion of mixtures of fuel fluids with air induction, in which these fluids are introduced into a burner body forming a venturi, by means of injectors with annular cross section arranged coaxially along the axis of said body. Such a device has the major disadvantage of being difficult to produce because it requires extremely careful machining. Moreover, it seemed desirable to improve its performance in order to improve the efficiency of the device and particularly the homogeneity of the fluid ejection velocity profile in the mixing tube of the venturi forming the burner.

The applicant has therefore done research to find solutions that are technologically satisfactory, simple, reliable, with low capital cost at a refinery as well as at a production site, to provide sufficient quantities of air for burning a gas fed under low pressure and containing hydrocarbons, while improving the conditions required for optimal combustion of this gas and in particular to obtain smokeless combustion.

BRIEF SUMMARY OF THE INVENTION

An object of the invention, therefore, is a device for the combustion of gas containing hydrocarbons that can be burned in the presence of air, in which the fuel gas arrives by a central supply comprising a tube situated in the axis of a body forming a venturi, characterized in that a plurality of gas supply tubes are arranged in at least one ring around the central supply of the body forming a venturi, at least the ends of these tubes having their axes appreciably parallel to the wall of the diverging part of this venturi.

Thus the device according to the invention has the particular advantage of allowing the complete combustion of a gas containing hydrocarbons, with no smoke, even when the pressure of the fuel gas is low and it contains condensates.

Other advantages and characteristics of the device according to the invention will be brought out in the description, to which are appended, solely for purposes of illustration, FIGS. 1, 2*a* and 2*b*.

DETAILED DESCRIPTION OF THE INVENTION

Figure 1:
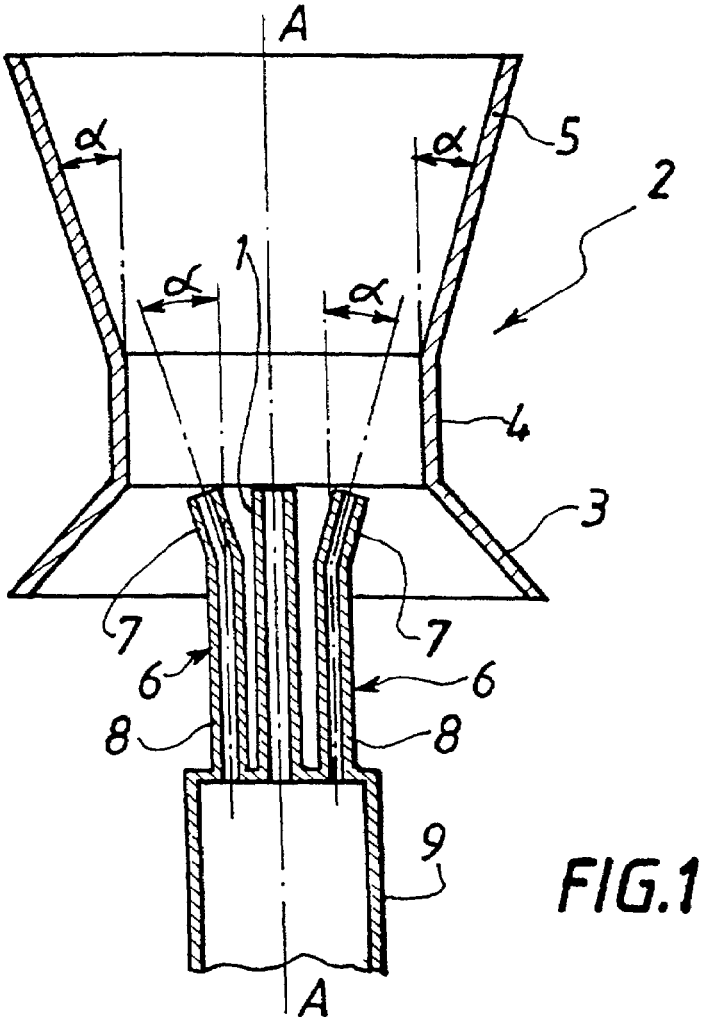
FIG. 1 diagrammatically represents a front view of a device according to the invention, in cross section along I—I.
Figure 2A:
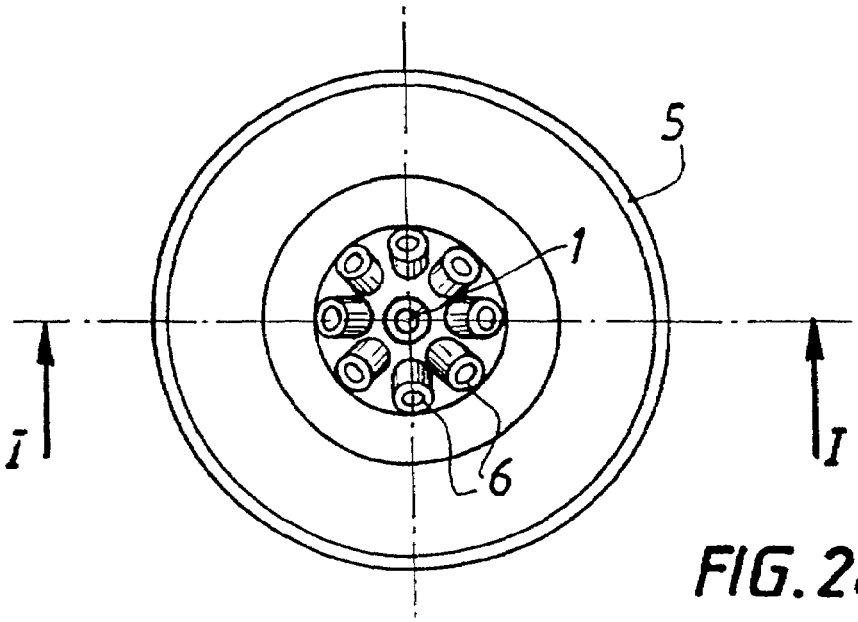
FIG. 2*a* diagrammatically represents a top view of the device of FIG. 1 with a plurality of tubes arranged annularly in a single ring the center of which is located on the axis of the body forming a venturi.

The device according to the invention, as represented in FIGS. 1 and 2*a*, comprises a central fuel gas supply 1 arranged at the center and at the input of a body 2 forming a venturi. The body 2 has a conical lower part 3 generally called "converging part" and which is extended by a cylindrical part 4 called "neck." This cylindrical part 4 is extended by a conical upper part 5 called "diverging part."

The central gas supply 1 generally has a central tube with annular cross section and which is essentially coaxial with the body 2. This central tube extends from the exterior into the converging part 3 up to a point situated in the body 2, generally at the level of the juncture of the converging part 3 and the neck 4.

According to the invention, a plurality of additional tubes 6 is provided around the central supply 1. The device according to the invention has at least three tubes arranged annularly, while the maximum number of tubes can reach several dozen, depending on the size of the body forming a venturi 2. The arrangement of the tubes 6 is generally regular and annular, as can be seen in FIGS. 2*a* and 2*b*.

Preferably these additional tubes 6 are essentially identical, have an essentially circular cross section and are arranged annularly around the central supply 1, with at least the axis of their end essentially parallel to the wall of the diverging part 5 of the body forming a venturi, in order to inject the fuel gas into said body while forming an angle $\alpha$ with the axis AA of this body forming a venturi. Their lower part 8 can be cylindrical and essentially parallel to the axis AA of the body 2, while, as can be seen in FIG. 1, the angle of inclination $\alpha$ of the upper part 7 with respect to the axis AA is essentially equal to the angle of inclination of the diverging part 5 with respect to this same axis AA. In one variation of the invention not represented in the figures, the axes of the tubes can form an angle with the axis of the body forming a venturi, equal to the one that the diverging part forms with the axis of said body.

Figure 2B:
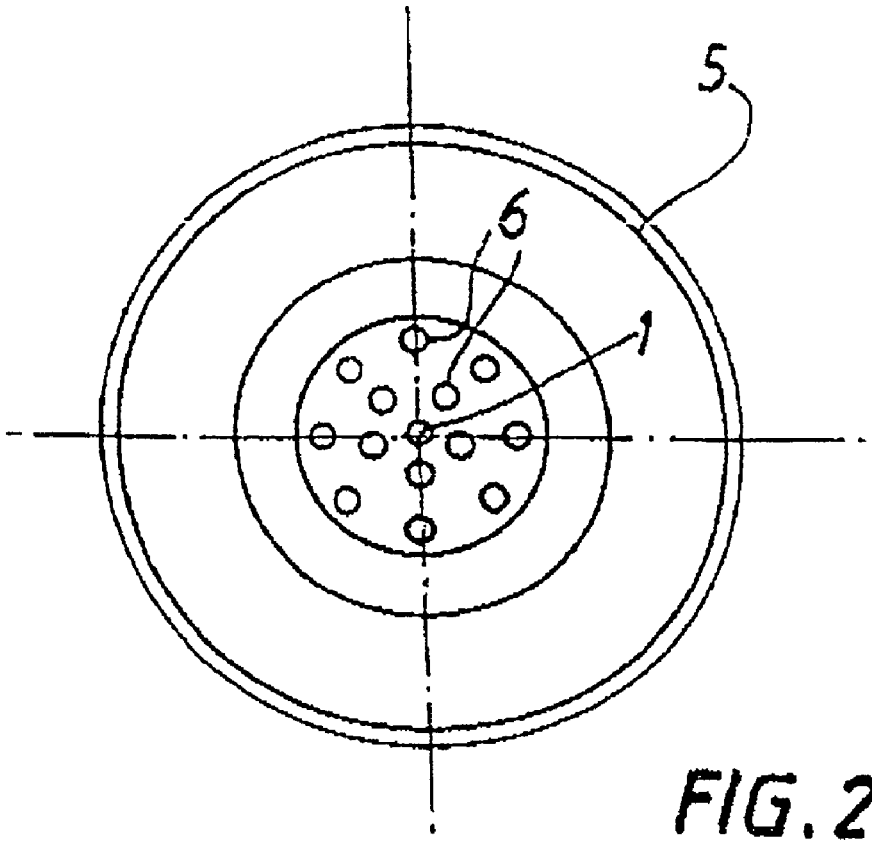
FIG. 2*b* diagrammatically represents a top view of a variation of the device of FIG. 1, with a plurality of tubes distributed in two rings.

The tubes can be arranged, as shown in FIG. 2*b*, annularly around the central fuel gas supply tube, in several rings the centers of which are situated on the axis AA of the body forming a venturi 2.

The additional tubes 6 penetrate into the body 2 very generally at the same depth, which can be the same or less than the depth of penetration of the central tube 1 in the body 2. This central tube can have a different diameter, preferably greater than the diameter of the annularly arranged tubes.

Each tube 6 is sized in such a way that, on the one hand its inside diameter is identical to that of all of the tubes arranged annularly in at least one ring, and on the other hand it can carry between 1% and 33% and preferably between 5% and 33% of the fuel gas. Moreover, the ends of all of the tubes arranged in at least one ring can be fitted with gas injection devices such as injection nozzles.

The central tube 1 as well as the additional tubes 6 arranged in at least one ring can all be connected to the same fuel gas supply tube 9. In this case, the are connected by means of the supply tube 9 to a source of fuel gas, which can be composed, for example, of hydrocarbons, hydrogen sulfide $H_2S$ or a mixture of these gases.

The combustion is produced at the outlet of the tubes 1 and 6, inside the body 2, but because of the presence of both the central tube 1 and the additional tubes 6, a better distribution of gas velocities is produced than that observed with standard burners, which promotes the exchanges as well as the turbulences between the motive fluid and the oxidant, i.e., the fuel gas leaving the tubes and the induced fluid, i.e., the air. The result is high performance in the entrainment of this air, which can be quantified by a general rate of dilution of the fuel gas in the air on the order of 40. (In comparison, standard burners have a dilution rate of 3 to 10.) Moreover, the entrainment of air by the device according to the invention is very high even when the device is supplied with a motive fluid at very low pressure.

The applicant has performed tests on a burner on the ground called "burn pit." When a standard burner is used, composed of a single feed tube for the gas to be burned and a venturi having only one central supply tube, the production of thick black smoke is noted, evidence of incomplete combustion of the gases. However, when the device according to the invention is installed under the same conditions of high flow rate and low pressure of the fuel gas, smokeless combustion is obtained. In addition, the condensates entrained in the flame also burn without smoke. In order to obtain complete combustion with the standard burner, a gas pressure 30 times greater would be needed.

Furthermore, the use of the device according to the invention produces operating conditions that favor the reduction of nitrogen oxides, such as combustion air in stages, the elimination of very hot areas of the flame by homogenization of its temperatures. This is clearly important, because it has been established that nitrogen oxides formed during combustion contribute to the acidification process, photochemical pollution, decrease in the ozone layer and increase in the greenhouse effect.

The invention claimed is:

1. Device for the combustion of gas containing hydrocarbons that can be burned in the presence of air, in which the fuel gas arrives by a central supply comprising a gas supply tube (1) situated along the axis of a body forming a venturi (2), wherein the venturi (2) comprises an upstream conical converging part (3), an intermediate cylindrical neck part (4) and a downstream conical diverging part (5), wherein a plurality of gas supply tubes (6) are annularly arranged in at least one ring around the gas supply tube (1), at least the ends of the annularly arranged gas supply tubes (6) having their axes diverging from the gas supply tube (1) and appreciably parallel to a wall of the downstream conical diverging part (5), wherein the gas supply tube (1) extends into the converging part (3) up to a first point situated at a level where the converging part (3) is joined to the neck (4), wherein the annularly arranged gas supply tubes (6) extend into the converging part (3) up to a second point, such that each of the annularly arranged gas supply tubes (6) extends up to the same second point, and wherein the second point is situated at the level where the converging part (3) is joined to the neck (4) or the second point is situated in the converging part (3) at a level before the converging part (3) is joined to the neck (4).

2. Device according to claim 1 wherein each of the annularly arranged gas supply tubes (6) is sized in such a way that it can carry between 1% and 33% of said gas.

3. Device according to claim 1, wherein the gas supply tube (1) has a diameter, each of the annularly arranged tubes (6) has a diameter, and the diameter of the gas supply tube (1) is different than the diameter of each of the annularly arranged tubes (6).

4. Device according to claim 2, wherein each of the annularly arranged gas supply tubes (6) is sized in such a way that it can carry between 5% and 33% of said gas.

5. Device according to claim 3, wherein the gas supply tube (1) has a diameter, each of the annularly arranged tubes (6) has a diameter, and the diameter of the gas supply tube (1) is greater than the diameter of each of the annularly arranged tubes (6).

* * * * *